US007290746B1

(12) United States Patent
Macias et al.

(10) Patent No.: US 7,290,746 B1
(45) Date of Patent: Nov. 6, 2007

(54) BEVERAGE CONTAINER HOLDER SUPPORTED TRAY ASSEMBLY

(76) Inventors: Nicky B. Macias, 1663 E. Alameda Pl., Casa Grande, AZ (US) 85222; Raul A. Landa, 1915 S. Falcon Dr., Higley, AZ (US) 85236

( * ) Notice: Subject to any disclaimer, the term of this patent is extended or adjusted under 35 U.S.C. 154(b) by 54 days.

(21) Appl. No.: 11/252,299

(22) Filed: Oct. 17, 2005

Related U.S. Application Data

(60) Provisional application No. 60/621,003, filed on Oct. 20, 2004.

(51) Int. Cl.
*A47K 1/08* (2006.01)

(52) U.S. Cl. ..... 248/311.2; 248/314; 248/315; 248/298.1; 248/297.31; 248/288.1; 248/222.11; 248/309.1; 108/42; 297/135; 297/145; 297/174 R; 297/188.18

(58) Field of Classification Search ..... 248/311.2, 248/314, 315, 298.1, 297.31, 286.1, 222.11, 248/309.1; 108/25, 26, 42, 44, 45, 134, 135; 297/135, 148, 149, 174 R, 160, 188.01, 188.11, 297/188.14, 188.16, 188.18; 224/926, 282
See application file for complete search history.

(56) References Cited

U.S. PATENT DOCUMENTS 1,581,250 A * 4/1926 Treubig ..... 248/311.2
2,640,595 A * 6/1953 Byford ..... 211/74
3,163,287 A * 12/1964 Barnett ..... 224/540
D199,993 S * 1/1965 Cohen ..... D12/420
3,675,969 A * 7/1972 Gage ..... 297/188.18
4,359,004 A * 11/1982 Chappell ..... 108/44
4,798,413 A * 1/1989 Capelli ..... 297/161
4,942,827 A * 7/1990 Norgaard ..... 108/44
4,989,742 A * 2/1991 Powell ..... 220/23.4
5,088,673 A * 2/1992 Chandler ..... 248/311.2
5,118,063 A * 6/1992 Young, Sr. ..... 248/311.2
5,170,720 A * 12/1992 Scheurer ..... 108/44
5,174,534 A * 12/1992 Mitchell ..... 248/311.2
5,294,026 A * 3/1994 McGirt ..... 224/549
5,326,064 A * 7/1994 Sapien ..... 248/311.2
5,397,089 A * 3/1995 Kataoka ..... 248/311.2
5,413,035 A * 5/1995 Fernandez ..... 100/44
5,503,297 A * 4/1996 Frankel ..... 220/751
5,556,181 A * 9/1996 Bertrand ..... 312/313
5,651,523 A * 7/1997 Bridges ..... 248/311.2
5,669,538 A * 9/1997 Ward ..... 224/539
5,720,516 A * 2/1998 Young ..... 297/188.18

(Continued)

*Primary Examiner*—Carl D. Friedman
*Assistant Examiner*—Michael McDuffie
(74) *Attorney, Agent, or Firm*—John D. Lister

(57) ABSTRACT

The multi-purpose beverage container holder supported tray assembly: includes a beverage container holder component and a tray component hingedly coupled to the beverage container holder component and provides one or more utilitarian support surfaces that may be used for various functions such as food and beverage placement, writing, and other activities where a stable, conveniently positioned surface is desired; and is adapted for use in theaters, stadiums, indoor and outdoor sports arenas, convention halls, home entertainment centers, and the like. The multi-purpose tray assembly is portable and removably supported in the seat arm beverage container holders (cup holders) normally found on the seating in the locations listed above. The position of the tray component of the tray assembly can be easily adjusted to suit the user and position the utilitarian support surface of the tray component in a location most convenient for the intended use.

13 Claims, 4 Drawing Sheets

U.S. PATENT DOCUMENTS 5,865,124 A * 2/1999 Wroe ..... 108/26
5,915,561 A * 6/1999 Lorenzana et al. ..... 206/562
5,971,139 A * 10/1999 Bradley ..... 206/217
5,992,331 A * 11/1999 Inoue et al. ..... 108/44
6,109,580 A * 8/2000 Stern et al. ..... 248/311.2
6,264,026 B1 * 7/2001 Bradley ..... 206/217
6,412,861 B1 * 7/2002 Herman et al. ..... 297/146
6,520,366 B1 * 2/2003 Bradley et al. ..... 220/23.2
6,533,233 B2 * 3/2003 Thomas ..... 248/311.2
6,732,990 B2 5/2004 Hudson
2001/0032791 A1 * 10/2001 Hudson ..... 206/217
2002/0185578 A1 * 12/2002 Hudson ..... 248/311.2
2004/0238537 A1 * 12/2004 Ojeda ..... 220/23.8
2006/0220423 A1 * 10/2006 Bergin ..... 297/160

* cited by examiner

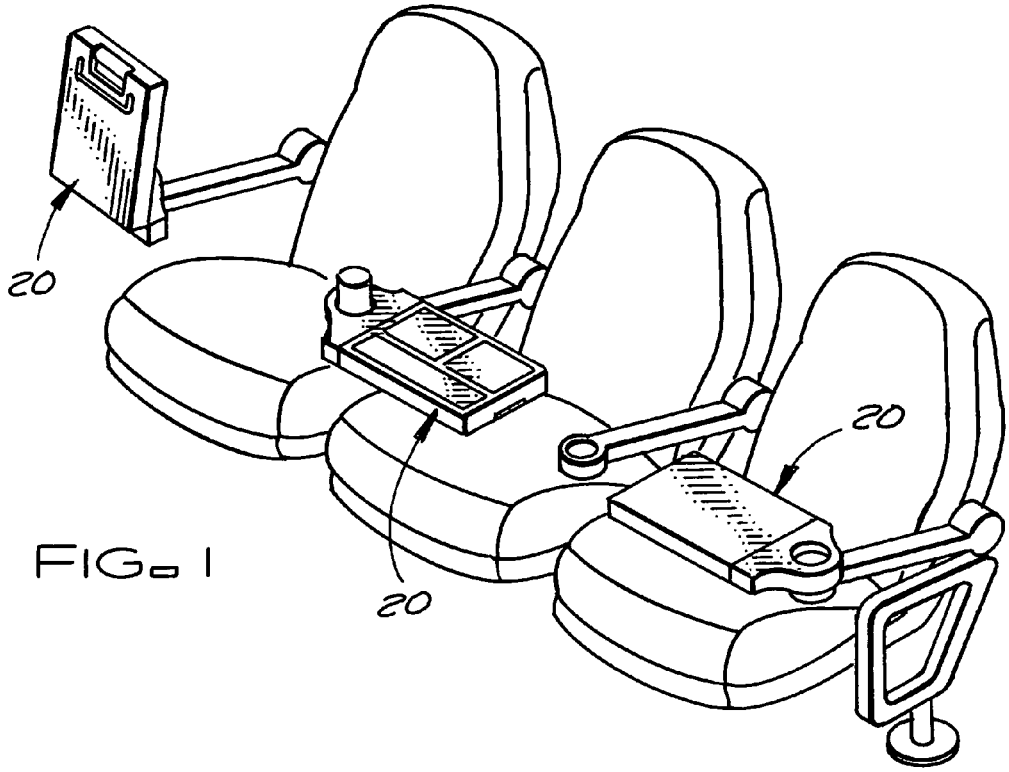
FIG. 1
FIG. 2
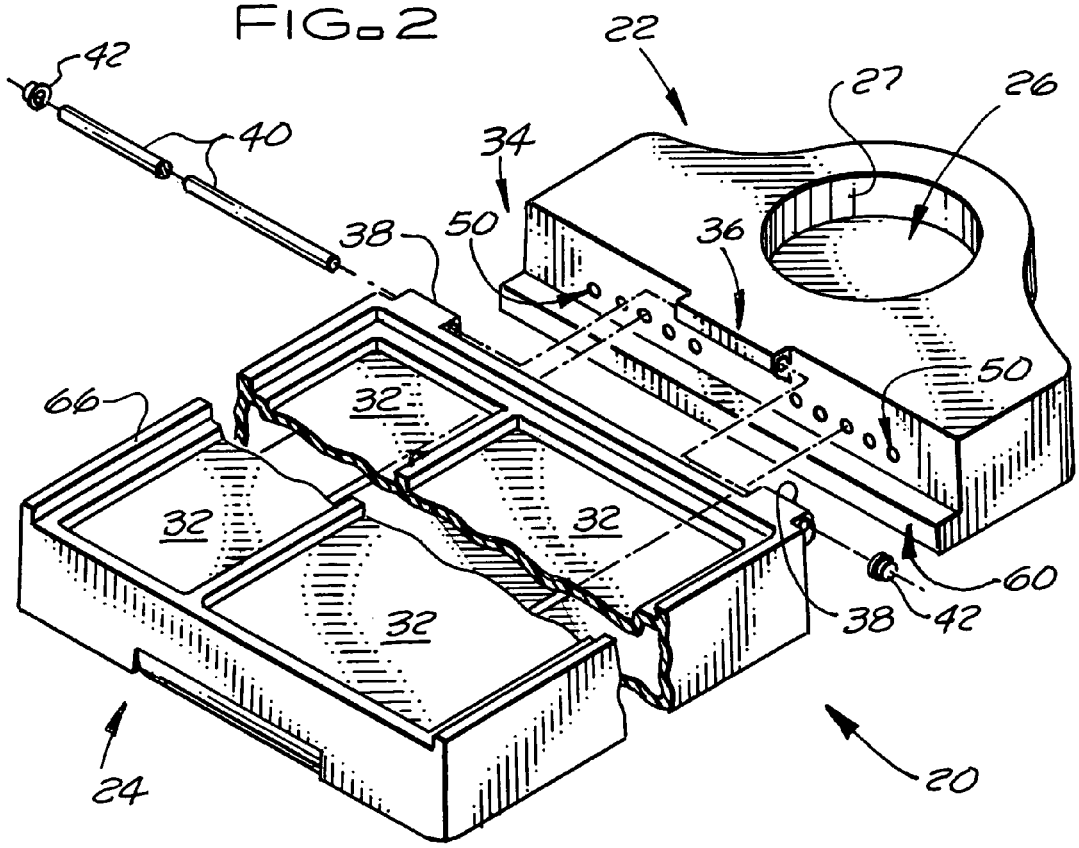

BEVERAGE CONTAINER HOLDER SUPPORTED TRAY ASSEMBLY

This patent application claims the priority and benefit of our U.S. Provisional Application No. 60/621,003, filed Oct. 20, 2004, which is incorporated herein in its entirety by reference.

BACKGROUND OF THE INVENTION

The multi-purpose beverage container holder supported tray assembly of the subject invention provides one or more utilitarian support surfaces that may be used for various functions such as eating (food and beverage placement), writing, and any of a number of other activities where a stable, conveniently positioned support surface is desired for the activity. The multi-purpose beverage container holder supported tray assembly of the subject invention is portable and is removably supported in the seat arm beverage container holders (commonly called cup holders) normally found on the seating in theaters, stadiums, indoor and outdoor sports arenas, convention halls, home entertainment centers, and the like. The multi-purpose beverage container holder supported tray assembly of the subject invention enables the user to have a secure support surface, for the placement of food and beverages, writing, or the performance of other activities, that can be easily adjusted and positioned in a location most convenient for the intended use.

SUMMARY OF THE INVENTION

The portable, multi-purpose, beverage container holder supported tray assembly of the subject invention includes a beverage container holder component and a tray component. The beverage container holder component has a beverage container holder (a holder for holding soft drink, beer, coffee, and other beverage cups; bottles; drinking glasses; etc) with a portion (preferably, a stepped section portion) extending downward from the bottom side of the beverage container holder component for being removably received in a conventional seat arm beverage container holder (such as those beverage container or cup holders used in theaters, stadiums, indoor and outdoor sports arenas, convention halls, home entertainment centers, and the like) to removably mount the tray assembly on the seat arm of seating having such a beverage container holder. The tray assembly of the subject invention can be removably supported in a seat arm beverage container holder (cup holder) located on the right or left arm of the seat and extended from the right or left arm of the seat over the seating area of the seat. The tray component has a topside utilitarian support surface that is typically provided with recessed receptacles for holding food and other items or is flat for writing or other tasks.

The tray component is pivotally coupled to the beverage container holder component, which supports the tray component. The tray component can be positioned in a first substantially horizontal utilitarian position wherein the tray component extends over a seating area of a seat when the beverage container holder means is mounted in a seat arm beverage container holder of the seat. The tray component can also be pivoted about a substantially horizontal axis from the first utilitarian position to a raised position to permit seat ingress and egress by a person using the tray assembly while the beverage container holder of the beverage container holder component of the tray assembly is still mounted in the seat arm beverage container holder of the seat. Preferably, the tray component can be adjusted forward and rearward relative to the beverage container holder component to adjust the tray component toward or away from a person using the tray assembly and preferably there is a releasable locking mechanism for selectively holding the tray component in a selected position relative to beverage container holder component and for supporting or at least partially supporting the tray component from the beverage container holder component.

BRIEF DESCRIPTION OF THE DRAWINGS

FIG. 1 is a schematic perspective view of theater, stadium, indoor and outdoor sports arena, convention hall, home entertainment center seating and the like showing portable, multi-purpose, beverage container holder supported tray assemblies of the subject invention: supported on a right arm of a seat and extending over a seating area of the seat, supported on a left arm of a seat and extending over a seating area of the seat, and supported on a right arm of a seat and swung out from over the seating area of the seat with the tray component of the tray assembly pivoted up to a raised position.

FIG. 2 is an exploded, fragmentary perspective view of a beverage container holder supported tray assembly of the subject invention.

DESCRIPTION OF THE PREFERRED EMBODIMENTS

Figure 3:
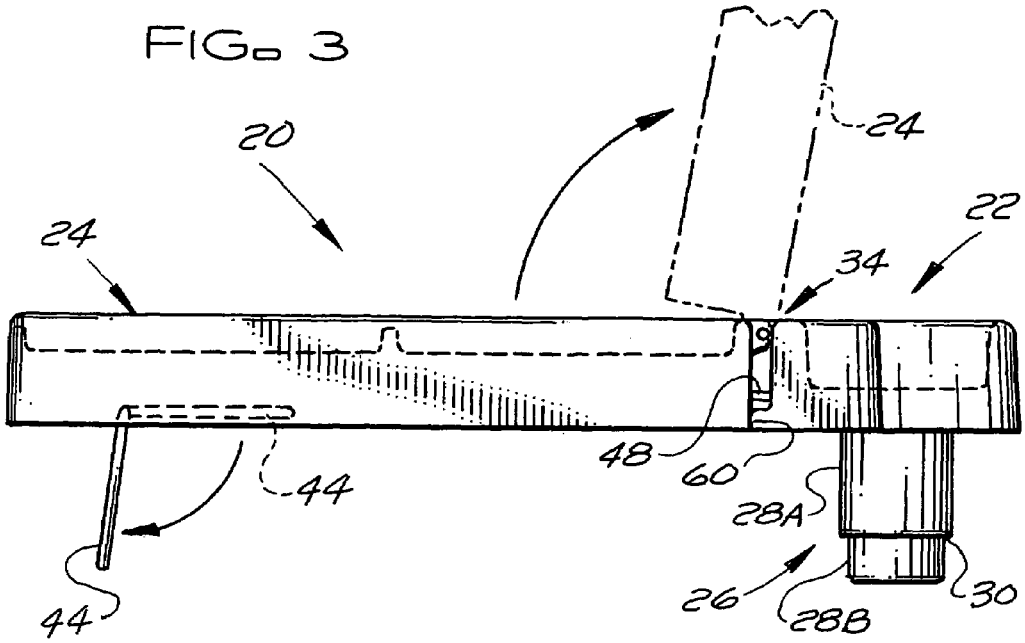
FIG. 3 is a side view of the beverage container holder supported tray assembly of FIG. 2. The beverage container holder supported tray assembly is shown with the tray component of the tray assembly in a normal use position (solid line) and the tray component of the tray assembly swung upward out of the normal use position (phantom line). In addition, a tray component support leg is shown in a normal use position (solid line) and in a stored position (phantom line).
Figure 4:
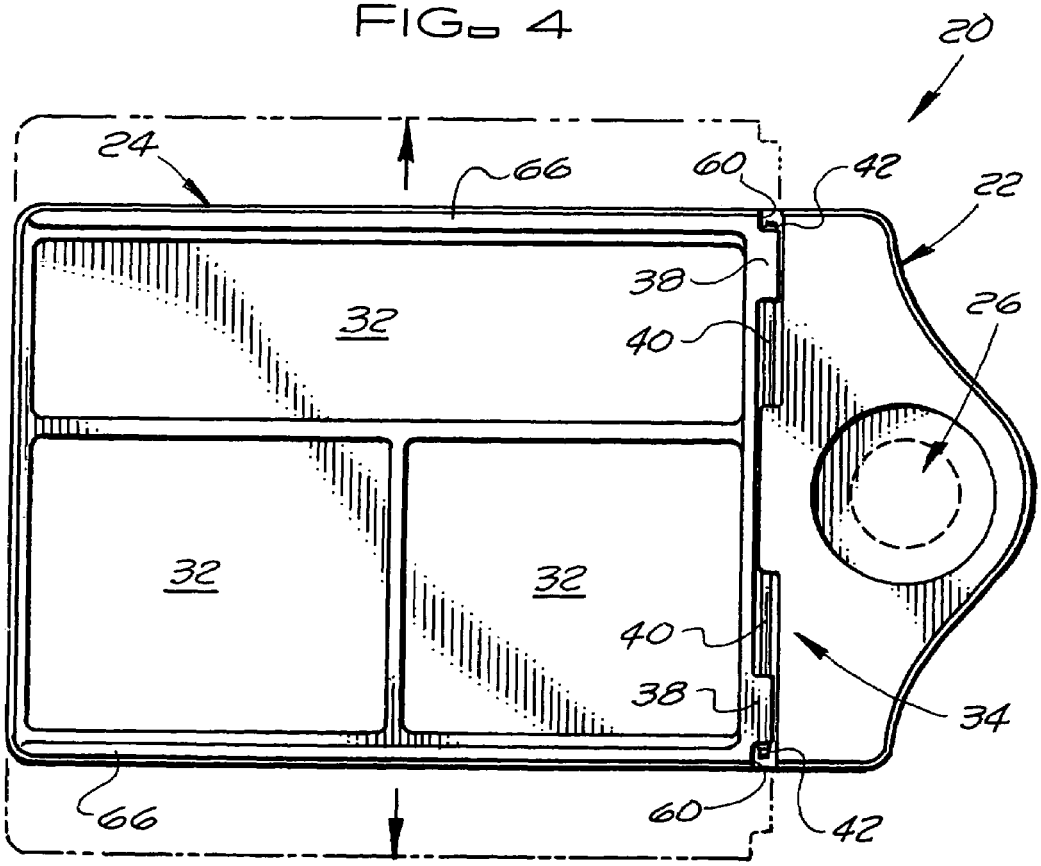
FIG. 4 is a top view of the beverage container holder supported tray assembly of FIG. 2. The beverage container holder supported tray assembly is shown with the tray section of the assembly in a centered use position (solid line) and in forward and rearward use positions (phantom line).

As shown in FIG. 1, which is a schematic perspective view of theater, stadium, indoor and outdoor sports arena, convention hall, home entertainment center seating and the like, the portable, multi-purpose, beverage container holder supported tray assembly 20 of the subject invention can be supported by a beverage container holder component 22 of the tray assembly on a right arm of a seat with a tray component 24 of the tray assembly extending over a seating area of the seat and supported by the beverage container holder component 22 on a left arm of a seat with the tray component 24 of the tray assembly extending over a seating area of the seat. The portable, multi-purpose, beverage container holder supported tray assembly 20 can also be supported on a right or left arm of a seat by the beverage container holder component 22 with the tray component 24 pivoted from a generally horizontal use position up to a raised position and supported on a right or left arm of a seat by the beverage container holder component 22 with the tray component 24 swung out from over the seating area of the seat and the tray component 24 of the tray assembly in a horizontal use position or a raised position.

As shown in FIGS. 2 to 6, the beverage container holder supported tray assembly 20 of the subject invention includes the beverage container holder component 22 and the tray component 24. The beverage container holder supported tray assembly 20 is typically reusable, but may be disposable. The beverage container holder supported tray assembly 20 may be made of various materials, such as but not limited to: conventional injected molded, durable thermoplastic polymer materials for reusable embodiments, paper stock for disposable embodiments, or a combination of such materials.

The beverage container holder component 22 of the tray assembly 20 has a beverage container holder 26 therein. The beverage container holder 26 has an uppermost section formed by a beverage container receptacle 27 that is internally sized in diameter to accommodate beverage containers of different types and diameters and has at least one and typically two or more stepped depending sections, such as depending sections 28A and 28B, that extend downward from the uppermost section 27 and the beverage container holder component 22 for mounting the tray assembly 20 on seating. The upper depending section 28A is larger in diameter than the lower depending section 28B and the tray assembly 20 is mounted in a seat arm beverage container holder by having at least the lower section 28B inserted into the seat arm beverage container holder of the seating. In the embodiment shown, the beverage container receptacle forming the uppermost section 27 of the beverage container holder 26 is closed at the bottom or substantially closed at the bottom, with a small drain hole to permit the drainage of fluids from the receptacle 27, so that the receptacle can support beverage containers placed in the receptacle 27 of lesser diameter than that of the receptacle. The depending section or sections 28A and 28B are typically tubular and open at the bottom to reduce material costs.

Seat arm beverage container holders normally range in diameter between about one and three quarters of an inch and about four inches. In one embodiment of the subject invention for mounting the tray assembly 20 on a seat arm with the beverage container holder component 22, the lower depending section 28B is sized to be received within essentially any conventional size seat arm beverage container holder of or associated with the arm of a seat (e.g. the section 28B is about one and one-half inches in diameter) and the upper depending section 28A is sized to either provide a closer fit with the generally cylindrical shaped sidewall of a seat arm beverage container holder when the upper depending section is also received within the seat arm holder (e.g. the section 28A is about two inches in diameter) or to provide a flange 30 at the juncture between the depending sections 28A and 28B, when the upper depending section 28A is not received within the seat arm beverage container holder, that will rest on the upper surface of the seat arm beverage container holder. With this embodiment of the subject invention, where both depending sections 28A and 28B of the beverage container holder 26 are received within a seat arm beverage container holder, the tray assembly 20 will be supported on the seat arm with the bottom side of the uppermost section 27 of the beverage container holder 26 resting on the upper surface of the seat arm beverage container holder and/or the bottom side of the beverage container holder component 22 resting on the upper surface of the seat arm. Where the flange 30 at the juncture of the depending sections 28A and 28B rests on the upper surface of the seat arm beverage container holder, the beverage container holder component 22 and the tray component 24 of the tray assembly 20 will be supported on the seat arm with the beverage container holder component 22 and the tray component 24 of the tray assembly 20 elevated above the level of the seat arm beverage container holder and/or seat arm by the upper depending section 28A of the beverage container holder 26.

In another embodiment of the subject invention, the depending sections 28A and 28B of the beverage container holder 26 form a stepped configuration with only the lower section 28B sized to be received within the seat arm beverage container holder of or associated with the arm of a seat (such as the conventional tubular seat arm beverage container holders normally found on seating in theaters, stadiums, indoor and outdoor sports arenas, convention halls, home entertainment centers, and the like). By having a beverage container holder 26 with a depending section 28A sized (e.g. about four and one-half inches in diameter) to be larger in diameter than the seat arm beverage container holders on or associated with seating (such as those commonly used in theaters, stadiums, indoor and outdoor sports arenas, convention halls, home entertainment centers, and the like) and depending section 28B sized to be smaller in diameter than section 28A and received in such seat arm beverage container holders, an annular flange 30 is formed at the juncture of the sections 28A and 28B for engaging and resting on the upper surface of a seat arm beverage container holder of a seat on which the tray assembly 20 is mounted. Preferably, the outside diameter and height of the beverage container holder section 28B are designed to ensure that the section 28B closely fits within and extends sufficiently far down into a seat arm beverage container holder to securely retain the beverage container holder 26 in the seat arm beverage container holder. Preferably, the outside diameter and height of the beverage container holder section 28A are designed ensure that the flange 30 formed at the juncture between the sections 28A and 28B is sufficiently wide to overlap the upper surface of a seat arm beverage container holder to an extent that a stable and secure support for the tray assembly 20 is provided and to locate the tray assembly 20 at a selected elevation relative to the seat arm beverage container holder and seat arm on which the tray assembly 20 is mounted. With this structure, when the tray assembly 20 is mounted on a seat arm beverage container holder, the annular flange 30 formed by the stepped design of the beverage container holder 26 engages the upper surface of the seat arm beverage container holder and the height of the section 28A of the beverage container holder sets the height of the top and bottom sides of the beverage container holder component 22 and the tray component 24 of the tray assembly 20 at a height that is convenient to the user for the intended use (typically at a height above the height of the upper surface of the seat arm).

The tray component 24 of the tray assembly 20 may be flat, but typically has shallow recessed receptacles 32 therein, which may be of various shapes and sizes, into which food and beverage containers or other articles may be placed. The beverage container holder component 22 and the tray component 24 are pivotally coupled together by a hinged coupling mechanism 34. As shown, the hinged coupling mechanism 34 includes one hinge knuckle 36 on one component and two hinge knuckles 38 on the other component. While the tray assembly 20 is shown with one hinge knuckle on the beverage container holder component 22 and two hinge knuckles on the tray component 24, the arrangement may be reversed. The hinge knuckle 36 is located intermediate the hinge knuckles 38 and a pin 40 passes through the hinge knuckles 36 and 38 to hingedly join the beverage container holder and tray components together so that the tray component 24 can be pivoted about a generally horizontal axis from the normal use position shown in solid line in FIG. 3 to a raised position shown in phantom line in FIG. 3. The spacing between the hinge knuckles 38 is greater than the length of the hinge knuckle 36 and the pin 40 is slidably received within the hinge knuckle 36 so that tray component 24 can be slid from the solid line centered position shown in FIG. 4 to forward or rearward positions shown in phantom line in FIG. 4. Press fit lock nuts 42 or other conventional fasteners are used at each end of the pin 40 to lock the pin in place in the hinged coupling mechanism 34.

Figure 5:
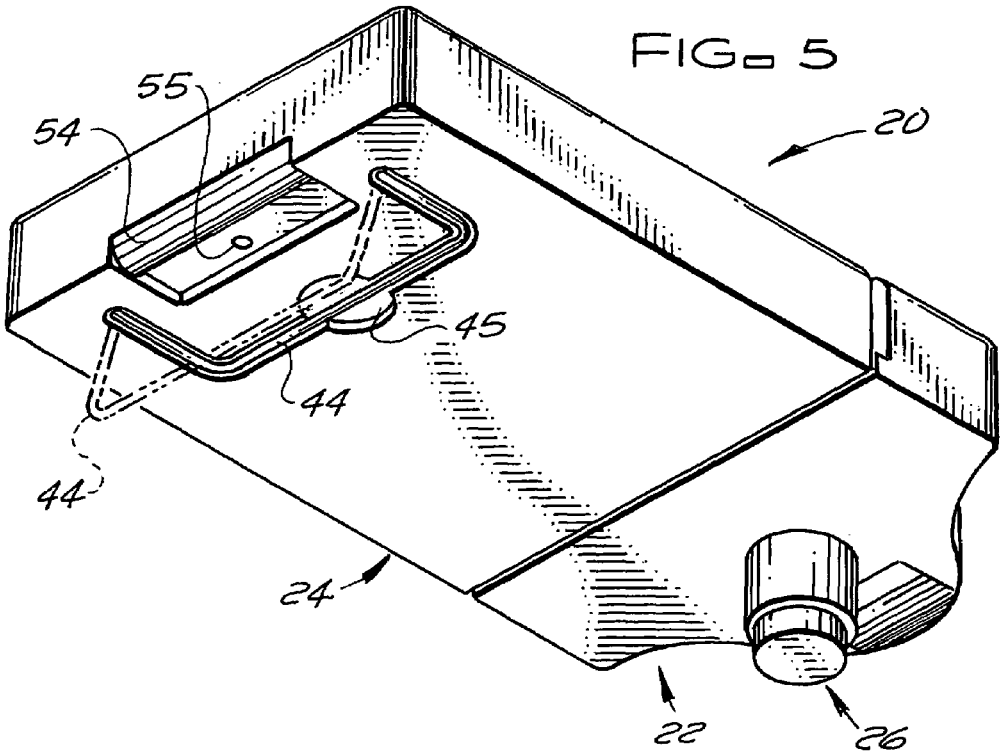
FIG. 5 is a bottom perspective view of the beverage container holder supported tray assembly of FIG. 2 with the support leg in its stored position (solid line) and an extended position (phantom line).

The tray component 24 is provided with a generally U-shaped support leg 44, shown in FIGS. 3 and 5, which can be pivoted from a tray supporting position shown in solid line in FIG. 3 and phantom line in FIG. 5 to a stored position shown in phantom line in FIG. 3 and solid line in FIG. 5. In the tray component supporting position, the support leg 44 can rest on a counter top or the lap of a person using the tray assembly 20. Preferably, the support leg 44 extends down from the tray assembly 20 the same or substantially the same distance as the depending sections of the beverage container holder 26 so that when the tray assembly 20 is placed on a counter or other flat surface, the tray assembly 20 will be level or substantially. Preferably, the bottom side of the tray assembly 24 includes a recess 45 for containing the support leg 44 in the stored position that is provided with an enlarged finger-receiving portion to enable the support leg to be easily gripped and swung down from the stored position into the supporting position.

Figure 6:
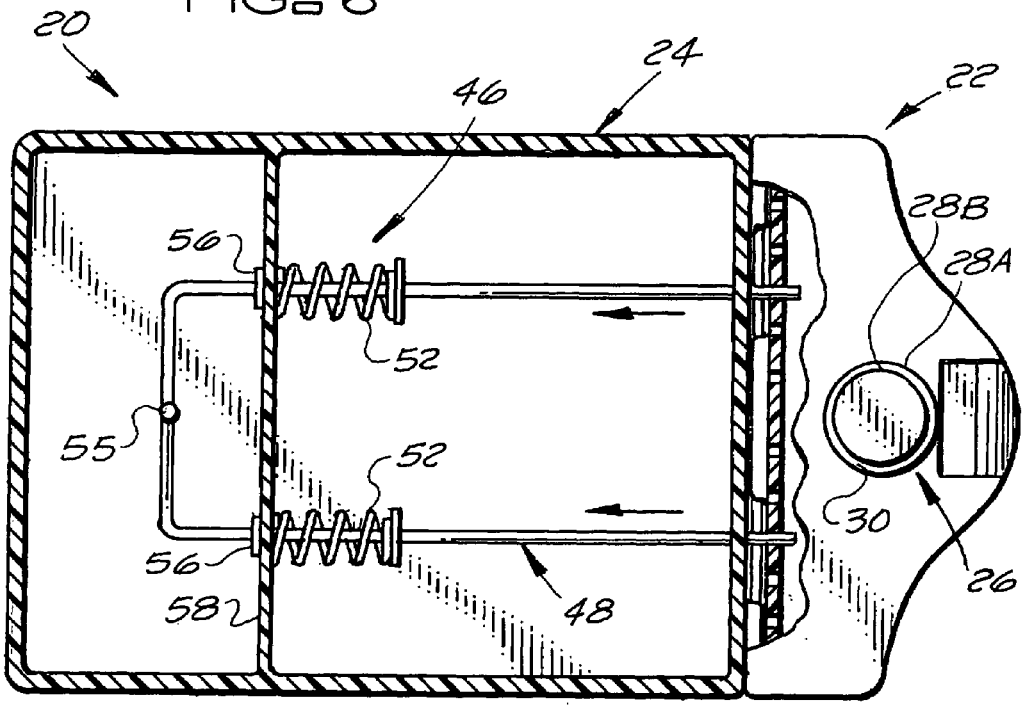
FIG. 6 is a bottom view of the beverage container holder component and tray component of the beverage container holder supported tray assembly of FIG. 2 with portions of the components broken away to better show the tray locking and support mechanism of the tray assembly. The beverage container holder supported tray assembly is shown with the tray component of the tray assembly in a normal use position and a tray locking and support mechanism in the locked position.

A tray component locking and support mechanism 46, shown in FIG. 6, includes a spring biased, generally u-shaped locking rod 48, which cooperates with a series of holes 50 in the beverage container holder component 22, to hold the tray component 24 in a number of selected positions relative to the beverage container holder component 22. When the tray component 24 is locked in position by the mechanism 46, the tray component 24 cannot be slid forward or rearward relative to the beverage container holder component 22 and preferably, cannot be pivoted with the hinged coupling mechanism 34 relative to the beverage container holder component 22. The coil springs 52 urge free ends of the locking rod 48 into holes of the series of holes 50 of the beverage container holder section 22 selected by the user to hold the tray section 24 in place at a desired location. By pulling outward on the handgrip 54 that is connected to of the locking rod 48 by pin 55, the free ends of the locking rod 48 can be moved out of the holes 50 so that the tray component 24 can be slid forward or rearward and/or pivoted with the hinged coupling mechanism 34. Once a desired location for the tray component 24 is reached, the user can release the handgrip 54 and let the free ends of the locking rod 48 be moved by the coil springs 52 into newly selected holes of the series of holes 50 to again lock the tray component 24 in place relative to the beverage container holder component 22. Stops 56 can be included on the locking rod 48 to cooperate with the locking rod support 58 to stop the locking rod 48 so that the free ends of the locking rod 48 do not project to far beyond the tray component 24, e.g. when the tray component 24 is swung upward as shown in phantom line in FIG. 3.

In addition, to holding the tray component 24 in place, with the free ends of locking rod 48 inserted into holes 50 of the beverage container holder component 22, the locking rod 48 also functions to support to the tray component 24 from the beverage container holder component 22. The end surface of the rib component 60 of the beverage container holder component 22 that abuts the opposing end surface of tray component 24 also functions to support to the tray component 24. While the inclusion of the tray locking and support mechanism 46 in the tray assembly 20 is preferred, the tray locking and support mechanism 46 does not have to be included in the tray assembly 20. While the U-shaped locking rod 48 is preferred for extra supporting strength and tray component stability, it is contemplated that the tray support and locking mechanism 46 could be made with a single spring biased rod that is selectively inserted into the holes 50 to hold the tray component in place.

Figure 7:
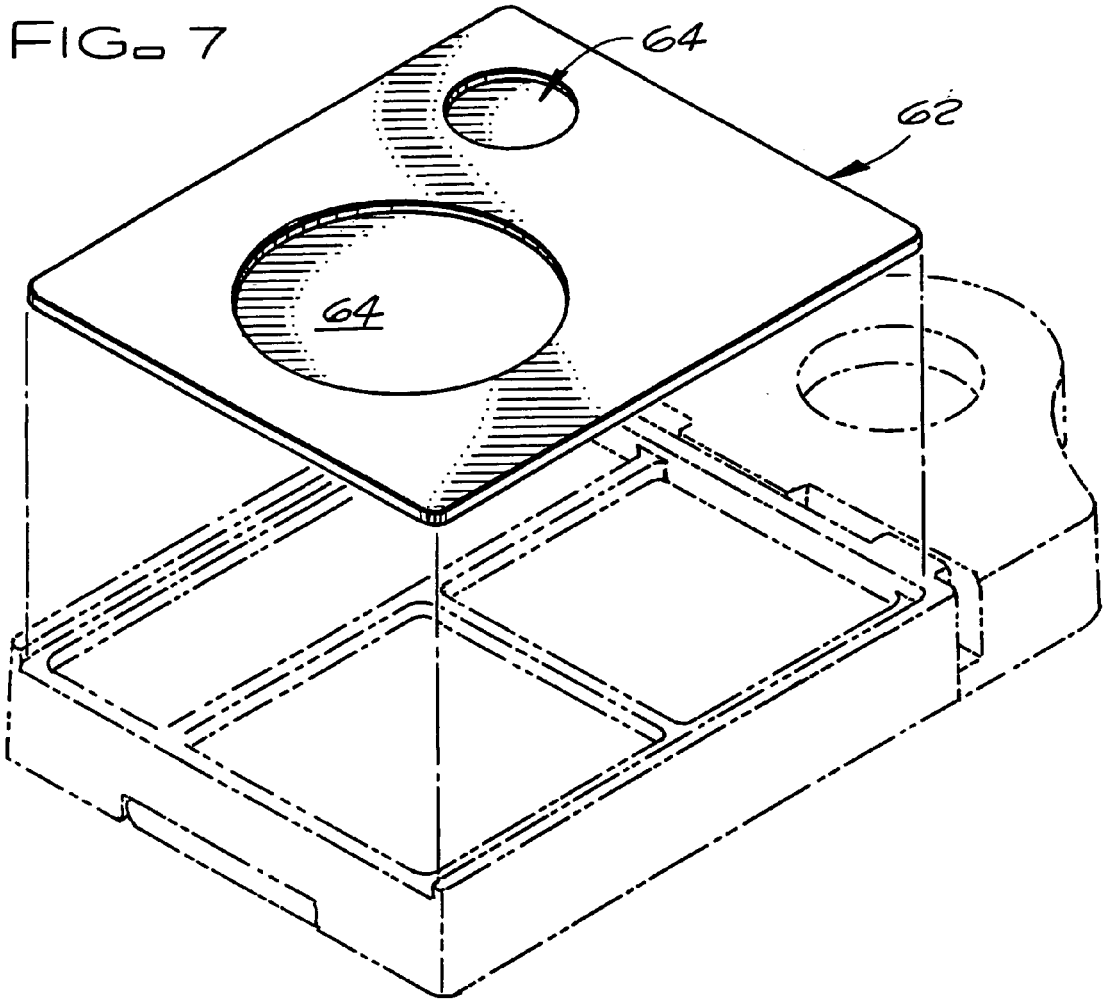
FIG. 7 is a top view of an adapter plate that can be placed, as shown, in the tray component of the tray assembly of FIG. 2 to convert the top surface of the tray component into a surface with recessed receptacles for holding a plate and beverage container or inverted and placed in the tray component of the tray assembly to convert the top surface of the tray component into a flat surface for writing and other uses.

The adaptor plate 62 of FIG. 7 has a first major surface with circular recessed plate and beverage container receptacles 64, as shown in FIG. 7, or another surface configuration and a second major surface that is flat (planar). Thus, the adaptor plate 62 may be used to convert the upper surface of the tray component 24 from a surface with recessed receptacles, such as the receptacles 32 shown in FIGS. 2 and 4, to a surface with circular recessed plate and beverage container receptacles 64 or another desired surface configuration or by inverting the adaptor plate 62 to a flat surface for writing or other uses. The adaptor plate 62 is sized to fit closely between the forward and rearward retaining ribs 66 of the tray component 24, shown in FIGS. 2 and 4, so that the adaptor plate can be slid or dropped into place and removably held in place on the tray component 24.

Figure 8:
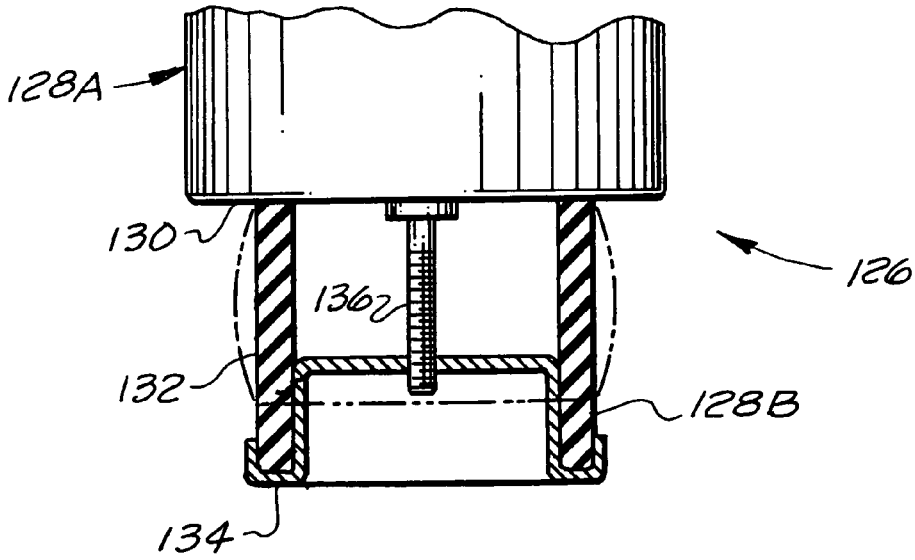
FIG. 8 is a side view, partially in vertical cross section, of a lower portion of an upper section and a lower section of an alternate embodiment of the beverage container holder of the beverage container holder component of the tray assembly of FIG. 2, wherein the lower section can be adjusted to expand horizontally to engage different size seat arm beverage container holders (cup holders).

FIG. 8 shows a lower portion of an upper depending section 128A and a lower depending section 128B of an alternate embodiment 126 of the beverage container holder 26 of the beverage container holder component 22 of the tray assembly 20 of FIGS. 2 to 6. In this embodiment, the lower depending section 128B of the beverage container holder 126 can be adjusted to expand horizontally in diameter (as shown in phantom line) and contract horizontally in diameter to releasably but closely engage different size seat arm beverage container holders. While other mechanisms can be used to expand and contract the lower depending section 128B in diameter, as shown, the tubular sidewall 132 of the lower depending section 128B of the beverage container holder 126 is flexible and resilient (e.g. a resilient rubber or resilient synthetic polymeric material). The upper end of the tubular sidewall 132 is free to rotate over the bottom surface 130 of the upper depending section 128A. The lower end of lower depending section 128B has a plastic or metal cap 134 that retains the lower end of the tubular sidewall 132 and is threaded onto a threaded rod 136 extending downward from and nonrotatably affixed to the bottom of the upper depending section 128A. By rotating the cap 134 clockwise, the cap 134 moves along the threaded rod 136 toward the bottom of the upper depending section 128A to cause the tubular sidewall 132 to deform outwardly and increase the diameter of the lower depending section 128B. By rotating the cap 134 counterclockwise, the cap 134 moves along the threaded rod 136 away from the bottom of the upper depending section 128A to permit the tubular sidewall 132 to return inward to or toward its undeformed state and diameter to reduce the diameter of the lower depending section 128B. Since the cap 134 is recessed into the lower depending section 128B to engage the threaded rod 136, the cap 134 can be moved up and down along the threaded rod 136 without having the threaded rod extend below the lower end of the lower depending section 128B.

It also is contemplated that the depending section of the beverage container holder 26 (the section of the beverage container holder that extends down from the bottom side of the beverage container holder component 22) could have an inverted frustoconical shape with the depending section of the beverage container holder 26 progressively decreasing in diameter from top to bottom so that the tray assembly 20 could be mounted in a seat arm beverage container holder by inserting the depending section of the beverage container holder 26 into a seat arm beverage container holder until the outer sidewall of the depending section engages the inner sidewall of the seat arm beverage holder. The sidewall of this frustoconical shaped depending section of the beverage container holder 26 could be made of a resilient material (e.g. a resilient rubber or resilient synthetic polymeric material) that when inserted into a seat arm beverage container holder, deforms to conform or partially conform to the inner surface of a seat arm beverage container holder or could be made of a series of depending resilient arms in a generally frustoconical or tubular configuration that, when the depending section is inserted into a seat arm beverage container holder, are flexed inwardly by the seat arm beverage container holder.

It is further contemplated that the beverage container holder sections 28A and 28B of the beverage container holder 26 can be telescoping with respect to each other and provided with a releasable locking mechanism or mechanisms to lock the beverage container holder sections 28A and 28B at different relative positions relative to each other to thereby adjust the height of the beverage container holder 26 and thus the height of the beverage container holder component 22 and the tray component 24 of the tray assembly 20 relative to a seat.

A typical multi-purpose beverage container holder supported tray assembly 20 is about twenty to twenty-three inches from side to side to extend from a seat arm across the seating area of the seat on which the tray assembly 20 is mounted and is about eleven to twelve inches from the front side to the rear side to provide a utilitarian surface that extends forward from the rear side of the tray assembly and a person using the tray assembly a distance sufficient for holding food and beverages when eating, writing, or other activities where a stable, conveniently positioned item supporting surface is desired. The beverage container holder component 22 is typically about six to seven inches from side to side and about eleven to twelve inches at its widest dimension from the front side to the rear side of the beverage container holder component. The beverage container holder 26 of the beverage container holder component 22 has an upper most section 27 that typically is about four inches in diameter to accommodate beverage containers of different types and diameters. The beverage container holder 26 typically has one or more (e.g. two depending sections 28A and 28B) that extend(s) downward from the beverage container holder component 22 from about two to about five inches. Where two depending sections are used, the upper depending section 28A is typically about two to about four and one-half inches in diameter by about an inch and one-half to about three in height (depends from the bottom side of the beverage container holder component about one and one-half inches) and the lower depending section 28B is typically about one and one-half to about three inches in diameter by about three quarters of an inch to about three inches in height. The tray component 24 is typically about fourteen to about fifteen inches from side to side by about eleven to about twelve inches from the front side to the rear side. The support leg 44 typically extends about two inches below the bottom side of the tray component 24 when the support leg 44 is extended. The beverage container holder component 22 and the tray component 24 are each typically about two inches in height or thickness from the topsides to the bottom sides of the components.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A portable, multi-purpose, beverage container holder supported tray assembly, comprising:

a beverage container holder component; the beverage container holder component having a top side and a bottom side, a beverage container holder means having depending means extending downward from the bottom side of the beverage container holder component for being removably received in a seat arm beverage container holder to removably mount the tray assembly on the seat arm;

a tray component; the tray component having a top side and a bottom side; the tray component having a first end and a second end; the top side of the tray component providing a utilitarian support surface; and coupling means joining the first end of the tray component to the beverage container holder component for supporting the tray component from the beverage container holder component in a first substantially horizontal utilitarian position wherein the tray component extends over a seating portion of a seat when the beverage container holder means is mounted in a seat arm beverage container holder of the seat and the utilitarian support surface is positioned for use by a person in the seat; the coupling means having hinge means with a substantially horizontal axis for permitting the tray component to be pivoted about the substantially horizontal axis from the first utilitarian position to a raised position to permit seat ingress and egress by a person using the tray assembly while the beverage container holder means of the beverage container holder component of the tray assembly is still mounted in the seat arm beverage container holder of the seat; and the coupling means permitting relative forward and rearward movement between the tray component and the beverage container holder component in a direction parallel to the substantially horizontal axis of the hinge means to adjust the tray component toward or away from a person using the tray assembly.

2. The portable, multi-purpose, beverage container holder supported tray assembly according to claim 1, wherein:

the tray assembly includes a releasable locking means for selectively holding the tray component in a selected position relative to beverage container holder component.

3. The portable, multi-purpose, beverage container holder supported tray assembly according to claim 1, wherein:

the tray assembly includes a releasable locking means for selectively holding the tray component in a selected position relative to beverage container holder component and at least partially supporting the tray component from the beverage container holder component.

4. The portable, multi-purpose beverage container holder supported tray assembly according to claim 3, wherein:

the beverage container holder means has an upper section with a receptacle for receiving a beverage container and the depending means of the beverage container holder means includes an upper depending section and a lower depending section extending downward from the bottom side of the beverage container holder component; the lower depending section is sized for removable insertion into a seat arm beverage container holder to mount the beverage container holder component of the tray assembly on the seat arm; and the upper depending section of the beverage container holder means is larger in diameter than the lower depending section of the beverage container holder means to thereby form, at a juncture of the upper and lower depending sections of the beverage container holder means, an annular flange for resting on an upper surface of a seat arm beverage container holder to support the beverage container holder component and the tray component of the tray assembly at a selected height.

5. The portable, multi-purpose beverage container holder supported tray assembly according to claim 4, wherein:

the lower depending section of the beverage container holder means includes means for enabling the lower depending section of the beverage container holder means to closely fit seat arm beverage container holders of different sizes.

6. The portable, multi-purpose beverage container holder supported tray assembly according to claim 5, wherein:

the tray component includes a support means, pivotally mounted to the tray component on the bottom side of the tray component, that is spaced inwardly from the second end of the tray component less than half the distance from the second end to the first end of the tray component for engaging and supporting the tray component by engaging a lap of a person sitting in a seat on which the tray assembly is mounted; and the support means being pivotal from a first stored position where the support means lies along the bottom side of the tray component to an extended support position where the support means extends downward from the bottom side of the tray component.

7. A portable, multi-purpose beverage container holder supported tray assembly, comprising:

a beverage container holder component; the beverage container holder component having a top side and a bottom side, a beverage container holder means having depending means extending downward from the bottom side of the beverage container holder component for being removably received in a seat arm beverage container holder to removably mount the tray assembly on the seat arm;

a tray component; the tray component having a top side and a bottom side: the tray component having a first end and a second end; the top side of the tray component providing a utilitarian support surface; and coupling means joining the first end of the tray component to the beverage container holder component for supporting the tray component from the beverage container holder component in a first substantially horizontal utilitarian position wherein the tray component extends over a seating portion of a seat when the beverage container holder means is mounted in a seat arm beverage container holder of the seat and the utilitarian support surface is positioned for use by a person in the seat; the coupling means having hinge means with a substantially horizontal axis for permitting the tray component to be pivoted about the substantially horizontal axis from the first utilitarian position to a raised position to permit seat ingress and egress by a person using the tray assembly while the beverage container holder means of the beverage container holder component of the tray assembly is still mounted in the seat arm beverage container holder of the seat;

the beverage container holder means having an upper section with a receptacle for receiving a beverage container and the depending means includes an upper depending section and a lower depending section extending downward from the bottom side of the beverage container holder component; the lower depending section being sized for removable insertion into a seat arm beverage container holder to mount the beverage container holder component of the tray assembly on the seat arm; and the upper depending section of the beverage container holder means being larger in diameter than the lower depending section of the beverage container holder means to thereby form, at a juncture of the upper and lower depending sections of the beverage container holder means, an annular flange for resting on an upper surface of a seat arm beverage container holder to support the beverage container holder component and the tray component of the tray assembly at a selected height; and the lower depending section of the beverage container holder means being adjustable in horizontal cross section to enable the lower depending section of the beverage container holder means to be selectively expanded and contracted to closely fit seat arm beverage holders of different sizes.

8. The portable, multi-purpose beverage container holder supported tray assembly according to claim 1, wherein:

the tray component includes a support means, pivotally mounted to the tray component on the bottom side of the tray component, that is spaced inwardly from the second end of the tray component less than half the distance from the second end to the first end of the tray component for engaging and supporting the tray component by engaging a lap of a person sitting in a seat on which the tray assembly is mounted; and the support means being pivotal from a first stored position where the support means lies along the bottom side of the tray component to an extended support position where the support means extends downward from the bottom side of the tray component.

9. The portable, multi-purpose beverage container holder supported tray assembly according to claim 1, wherein:

the topside of the tray component has flat-bottomed recessed receptacles therein for holding articles.

10. The portable, multi-purpose beverage container holder supported tray assembly according to claim 1, wherein:

the top side of the tray component has flat bottomed recessed receptacles therein for holding articles; and the tray assembly includes an adaptor plate having a first major surface that is planar and a second major surface with recesses therein for holding articles that is detachably mounted on the top side of the tray component to provide, at a user's option, the top side of the tray component of the tray assembly with the first major surface or the second major surface.

11. The portable, multi-purpose beverage container holder supported tray assembly according to claim 1, wherein:

the topside of the tray component has flat-bottomed recessed receptacles therein for holding articles; and the tray assembly includes an adaptor plate with a planar top major surface that is detachably mounted on the topside of the tray component to provide the topside of the tray component of the tray assembly with a planar surface.

12. The portable, multi-purpose beverage container holder supported tray assembly according to claim 1, wherein:

the topside of the tray component has flat bottomed recessed receptacles therein for holding articles wherein the receptacles are defined by low peripheral rims.

13. The portable, multi-purpose beverage container holder supported tray assembly according to claim 1, wherein:

the depending means of the beverage container holder means includes means for enabling the depending means of the beverage container holder means to closely fit seat arm beverage container holders of different sizes.

* * * * *